US005435825A

United States Patent [19]

Kusui et al.

[11] Patent Number: 5,435,825

[45] Date of Patent: Jul. 25, 1995

[54] ALUMINUM MATRIX COMPOSITE POWDER

[75] Inventors: Jun Kusui, Yokaichi; Fumiaki Nagase, Kashiwara; Akiei Tanaka, Omi-Hachiman; Kohei Kubo, Gamo; Takamasa Yokote, Nara, all of Japan

[73] Assignee: Toyo Aluminum Kabushiki Kaisha, Kyutaru, Japan

[21] Appl. No.: 926,892

[22] Filed: Aug. 7, 1992

[30] Foreign Application Priority Data

Aug. 22, 1991 [JP] Japan ..... 3-235557

[51] Int. Cl.[6] ..... C22C 29/12

[52] U.S. Cl. ..... 75/232; 75/236; 75/244; 75/249; 75/255; 75/351; 75/355

[58] Field of Search ..... 75/252, 254, 232, 236, 75/244, 249, 351, 331, 355

[56] References Cited

U.S. PATENT DOCUMENTS

| | | | |
|---|---|---|---|
| 3,551,143 | 12/1970 | Marukawa et al. | 75/138 |
| 3,816,080 | 6/1974 | Bomford et al. | 75/233 |
| 3,877,884 | 4/1975 | Tawarada et al. | 148/437 |
| 3,885,959 | 5/1975 | Badra et al. | 75/138 |
| 4,623,388 | 11/1986 | Jatkar et al. | 75/232 |
| 4,891,059 | 1/1990 | Diamond et al. | 75/352 |
| 4,946,500 | 8/1990 | Zadalis et al. | 75/232 |
| 5,006,417 | 4/1991 | Jackson et al. | 428/614 |
| 5,022,918 | 6/1991 | Koike et al. | 75/229 |
| 5,199,971 | 4/1993 | Akechi | 75/249 |

FOREIGN PATENT DOCUMENTS

| | | |
|---|---|---|
| 0262869 | 7/1988 | European Pat. Off. . |
| 3721258 | 4/1988 | Germany . |
| 61-166287 | 5/1986 | Japan . |
| 1-501489 | 5/1989 | Japan . |
| 1177340 | 7/1989 | Japan . |
| 1-306506 | 12/1989 | Japan . |
| 3-122201 | 5/1991 | Japan . |

OTHER PUBLICATIONS

Woldman's Engineering Alloys, 7th Edition, p. 1457, U.S. Materials Park, ASM International (1990).

Advanced Materials & Processes, vol. 138, No. 5, Nov. 1990, Ohio, US pp. 71–73 "Rapid-solidification processing improves MMC properties".

*Primary Examiner*—Ngoclan T. Mai

*Attorney, Agent, or Firm*—David G. Conlin; George W. Neuner

[57] ABSTRACT

Disclosed herein is an aluminum matrix composite powder comprising 1 to 40% by weight of ceramic particles dispersed in a matrix of aluminum-silicon alloy. The matrix of the composite may further comprise at least one of Cu, Mg and transition metals.

The aluminum matrix composite is prepared by a rapid solidification.

In the aluminum matrix composite, the ceramic particles are very uniformly dispersed in the matrix, thereby the improvement of mechanical properties of product prepared therefrom can be obtained.

11 Claims, 2 Drawing Sheets

ALUMINUM MATRIX COMPOSITE POWDER

FIELD OF THE INVENTION

The present invention relates to an aluminum matrix composite powder. More specifically, it relates to the aluminum matrix composite powder in which ceramic particles are very uniformly dispersed. And, it relates to a consolidated product resulting from such an aluminum matrix composite powder.

BACKGROUND OF THE INVENTION

Aluminum and aluminum alloys have excellent properties including light weight, high corrosion resistance and high thermal conductivity. Therefore, they have been widely applied to products which are required to have the above properties, such as aircraft, automobiles and other mechanical components.

However, the aluminum and the aluminum alloys have poor properties such as low strength, especially at the temperature of 200° C. or more, high coefficient of thermal expansion and low modulus of rigidity. These defects limit the applications of the aluminum and the aluminum alloys.

For improving the defects of the aluminum and the aluminum alloys, aluminum matrix composites comprising the ceramic particles dispersed in the matrices of aluminum or aluminum alloys are developed.

As methods for preparing the aluminum matrix composite comprising ceramic particles, three methods are known. The first method comprises impregnating a molten aluminum or aluminum alloy into a preform formed from the ceramic particles (please see Japanese Patent kokai No. 89/306506). A part of the composite prepared according to the first method are commercialized. In practice, the reason that the ceramic content should be selected to be relatively high (generally 20% by volume or more) for forming the preform limits the application of the first method. The second method comprises mixing the aluminum or aluminum alloy powder with the ceramic particles under a dry condition (please see Japanese Patent kokai No. 91/122201). Although the ceramic content can be suitably selected, the second method is not practically applied, because the uniform mixture of the aluminum or aluminum alloy powder with the ceramic particles is technically very difficult. The third method comprises dispersing the ceramic particles in the molten aluminum or aluminum alloy (please see Japanese Patent kohyo No. 89/501489). In the third method, the ceramic content can be suitably selected and the dispersion of the ceramic particles in the molten aluminum or aluminum alloy is relatively uniform as compared with the mixture of the second method. However, the third method is not practically applied, because as shown in the following comparative example, alloying elements and the ceramic particles may segregate near grain boundaries and/or they may not uniformly dispersed due to a slower solidification rate, thereby a product resulting from this composite has poor mechanical properties.

SUMMARY OF THE INVENTION

An object of the present invention is to provide the aluminum matrix composite powder in which a suitable amount of the ceramic particles are very uniformly dispersed.

Another object of the present invention is to provide the aluminum matrix composite powder from which the product having improved mechanical properties including strength, modulus of elasticity, ductility and wear resistance can be obtained.

Accordingly, the present invention provides the aluminum matrix composite powder comprising 1 to 40% by weight of the ceramic particles.

DETAILED EXPLANATION OF THE INVENTION

Figure 1:
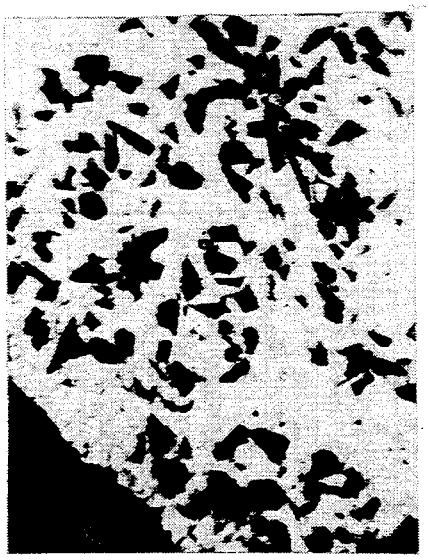
FIG. 1 is an optical microphotograph of atomized powder in accord with an embodiment of the present invention.

The term "ceramic particles" herein means not only the ceramic in the form of particles, but also the ceramic in the form of fibers, flakes or whiskers. The ceramic content in the aluminum matrix composite powder of the present invention should be 1 to 40% by weight. When it is less than 1% by weight, the improvement in mechanical properties of the product is not satisfactory. On the other hand, when it is above 40% by weight, the uniform dispersion of the ceramic particles in the matrix cannot be obtained.

The ceramic particles usable in the present invention includes oxides such as $Al_2O_3$, $SiO_2$ and mullite; carbides such as SiC and TiC; nitrides such as $Si_3N_4$; and borides such as $TiB_2$. The ceramic particles having average particle size of 1 to 40 μm are preferable. The reason is that when the average particle size is less than 1 μm, the ceramic particles tend to aggregate mutually and thereby they are hardly dispersed uniformly in the matrix. The ceramic particles having the average particle size of above 40 μm is also unpreferable, because they may act as points from which the occurrence of cracks starts in the product.

The matrix in the aluminum matrix composite powder of the present invention comprises aluminum and optionally any other elements. When the product having heat resistance is desired, one or more of Si, Cu and Mg elements may be added in the matrix. Generally 1 to 50% by weight of Si, 0.5 to 10% by weight of Cu and/or 0.5 to 10% by weight of Mg are added in the matrix, thereby the strength at a high temperature up to 150° C. can be also improved. This improvement is considered to be mainly due to a precipitation strengthening or hardening by very fine precipitates. To further improve the heat resistance at higher temperature, at least one of transition metals including Fe, Ni, Mn, Cr, V, Ti, Mo, Nb, Zr and Y may be added in the matrix. Generally 0.5 to 15% by weight in total of the transition metals are added in the matrix, thereby the heat resistance at higher temperature above 150° C. can be improved. This improvement is considered to be mainly due to dispersion strengthening or hardening by intermetallic compounds. The aluminum matrix composite powder of the present invention is prepared by a rapid solidification method, for example an atomization and a spinning disk atomization. The solidification rate is preferably $10^2$ K/sec or more, thereby fine primary crystals and fine precipitates are very uniformly dispersed in the matrix.

The aluminum matrix composite powder of the present invention is mainly used for the preparation of consolidated products. Generally, the consolidated product is prepared by subjecting to cold shaping followed by hot working such as a hot extrusion, a hot forging or a hot pressing. Alternatively, the aluminum matrix composite powder of the present invention can be directly used as a powder for thermal spray coating and a abrasive powder.

EXAMPLES

The present invention will be better understood by reference to certain experimental examples which are included herein for purposes of illustration only and are not intended to be limiting of the invention. All percentages referred to herein is by weight unless otherwise indicated.

Example 1

Figure 2:
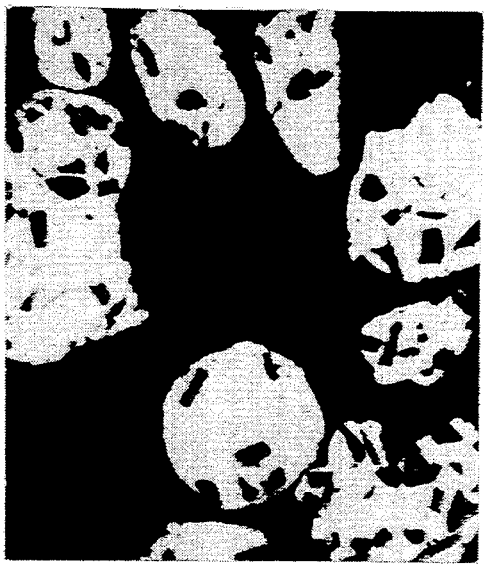
FIG. 2 is an optical microphotograph of atomized powder in accord with an embodiment of the present invention.

Into a molten aluminum alloy having the composition Al—8Si—2Cu—1Mg, 15% of SiC particles (average particle size=10 μm) were uniformly dispersed. The thus prepared melt was subjected to the atomization using pressurized air. The thus atomized aluminum matrix composite powders contained coarse powders having the particle size of 177 to 350 μm and fine powders having the particle size of 44 to 63 μm, the average particle size being 35 μm. FIGS. 1 and 2 are optical microphotographs (×400) of the resultant atomized composite powders. FIGS. 1 and 2 clearly show that the SiC particles were very uniformly dispersed in the matrix of the aluminum alloy. The solidification rate of the melt was estimated to be $10^2$ to $10^4$ K/sec, comparing with the aluminum alloy powder atomized under the same condition. This estimation is supported by FIGS. 1 and 2 showing that the precipitates dispersed in the matrix were very fine.

Figure 3:
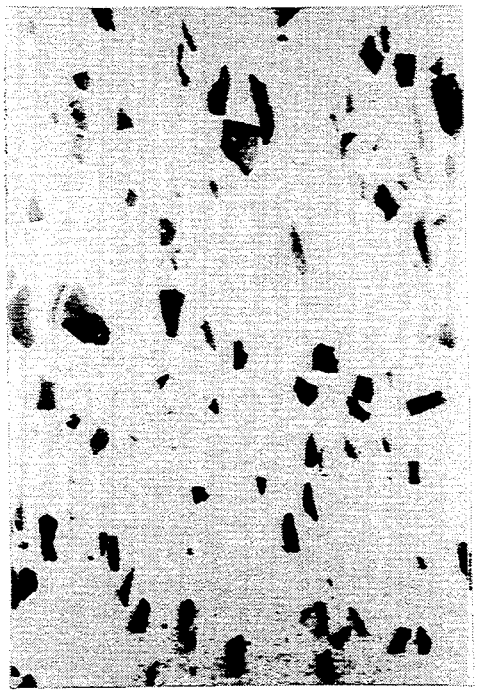
FIG. 3 is an optical microphotograph of an extended product prepared using a composition of the present invention.

After sieving so as to collect the powders having the particles size of 350 μm or less, the atomized composite powders were cold pressed isotropically, thereby a preform (green density=60 to 80%) was prepared. Then, the preform was heated to 480° C. and extruded at an extrusion ratio of 10 so as to obtain an extruded product (theoretical density=100%). FIG. 3 is the optical microphotograph (×400) of the resultant extruded product. FIG. 3 clearly shows that the SiC particles were very uniformly dispersed in the matrix of the aluminum alloy.

Comparative Example

Figure 4:
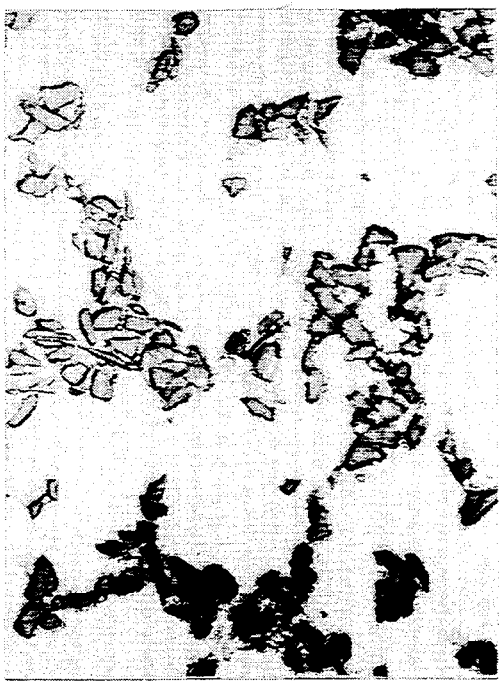
FIG. 4 is an optical microphotograph of a cast aluminum matrix composite.

Into a molten aluminum alloy having the composition Al—8Si—2Cu—1Mg, 15% of SiC particles (average particle size=10 μm) were uniformly dispersed. The thus prepared melt was directly casted. FIG. 4 is the optical microphotograph (×400) of the resultant casted aluminum matrix composite. FIG. 4 clearly shows that the dispersion of the SiC particles in the matrix was very poor, as compared with that in the atomized composite powder as shown in FIGS. 1 to 3. The reason of obtaining the ununiform dispersion is the solidification rate being slower.

The dispersibilities of the extruded product prepared from the atomized composite powders of Example 1 and the casted composite were quantitatively determined. That is, the distance between centers of gravity of closest SiC particles was determined with a picture analyzer "Gazo Hakase" (trade name of Kawasaki Steel Corporation). The determination was conducted on three fields of view, each view being 180×230 μm. Each view was selected so that the number of the SiC particles observed is as constant as possible. The result is shown in Table 1.

TABLE 1

| | distance between centers of gravity of closest particles (μm) | | | | average number of observed particles |
|---|---|---|---|---|---|
| | 1 view | 2 view | 3 view | average | per field of view |
| invention | 5.72 | 5.55 | 5.94 | 5.74 | 156 |
| control | 3.70 | 4.17 | 3.78 | 3.88 | 161 |

The distance between centers of gravity of closest particles in the extruded product of the present invention is longer by about 1.5 times as compared with that in the casted composite of the control. Therefore, the dispersibility of the atomized composite powder is clearly superior to that of the casted composite.

Example 2

Into a molten aluminum alloy having the composition Al—9Si—1Mg, 3% of SiC particles (average particle size=25 μm) were uniformly dispersed. The thus prepared melt was subjected to the atomization using pressurized air, thereby the atomized aluminum matrix composite powders (average particle size=28 μm) were obtained. The optical microphotograph showed that the atomized composite powders comprised the SiC particles dispersed very uniformly in the matrix of the aluminum alloy.

The extruded product was obtained using the above atomized composite powders according to the procedures described in Example 1. The optical microphotograph showed that in the extruded product, the SiC particles were dispersed very uniformly in the matrix of the aluminum alloy.

Example 3

Into a molten aluminum alloy having the composition Al—7Si—1Cu—1Mg, 25% of SiC particles (average particle size=5 μm) were uniformly dispersed. The thus prepared melt was subjected to the atomization using pressurized air, thereby the atomized aluminum matrix composite powders (average particle size=32 μm) were obtained. The optical microphotograph showed that the atomized composite powders comprised the SiC particles dispersed very uniformly in the matrix of the aluminum alloy.

Example 4

Into a molten aluminum alloy having the composition Al—9Si—1Mg, 10% of $Al_2O_3$ particles (average particle size=10 μm) were uniformly dispersed. The thus prepared melt was subjected to the atomization using pressurized air, thereby the atomized aluminum matrix composite powders (average particle size=30 μm) were obtained. The optical microphotograph showed that the atomized composite powders comprised the $Al_2O_3$ particles dispersed very uniformly in the matrix of the aluminum alloy.

Example 5

Into a molten aluminum alloy having the composition Al—20Si—3Mg, 3% of SiC particles (average particle size=15 μm) were uniformly dispersed. The thus prepared melt was subjected to the atomization using pressurized air, thereby the atomized aluminum matrix composite powders (average particle size=28 μm) were obtained. The optical microphotograph showed that the atomized composite powders comprised the SiC particles dispersed very uniformly in the matrix of the aluminum alloy.

The extruded product was obtained using the above atomized composite powders according to the procedures described in Example 1. The optical microphotograph showed that in the extruded product, the SiC particles were dispersed very uniformly in the matrix of the aluminum alloy.

Example 6

Into a molten aluminum alloy having the composition Al—1Si—5Cu—2Mg, 25% of SiC particles (average particle size=5 μm) were uniformly dispersed. The thus prepared melt was subjected to the atomization using pressurized air, thereby the atomized aluminum matrix composite powders (average particle size=32 μm) were obtained. The optical microphotograph showed that the atomized composite powders comprised the SiC particles dispersed very uniformly in the matrix of the aluminum alloy.

Example 7

Into a molten aluminum alloy having the composition Al—10Si—3Cu—1Ni—1Mg, 20% of SiC particles (average particle size=25 μm) were uniformly dispersed. And, into a molten aluminum alloy having the same composition, 20% of SiC particles (average particle size=25 μm) were uniformly dispersed, to which 2% or 4% of Fe was added. The thus prepared melts were subjected to the atomization using pressurized air, thereby the atomized aluminum matrix composite powders (average particle size=38 μm) were obtained. The optical microphotographs showed that the atomized composite powders comprised the SiC particles dispersed very uniformly in the matrices of the aluminum alloys.

Figure 5:
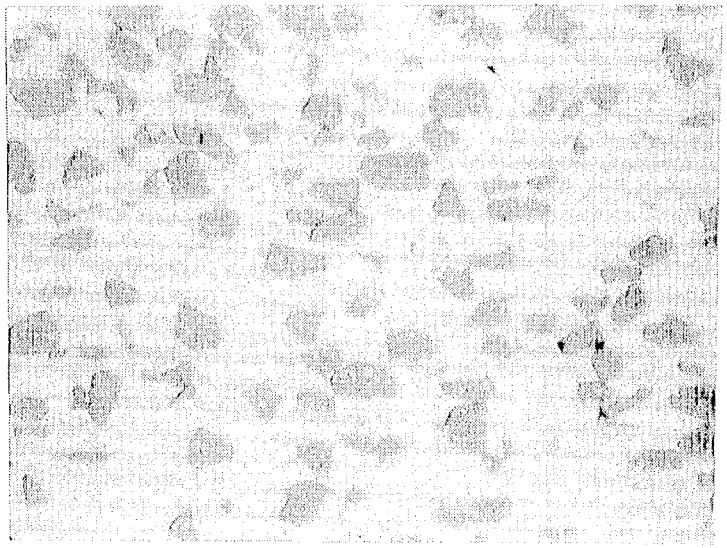
FIG. 5 is an optical microphotograph of an extended product prepared using a composition of the present invention.

The extruded products were obtained using the above atomized composite powders according to the procedures described in Example 1. FIG. 5 is the optical microphotograph (×400) of the resultant extruded product prepared from the composite powders comprising the SiC particles dispersed in the matrix of the aluminum alloy. FIG. 5 clearly shows that in the extruded product, the SiC particles were dispersed very uniformly in the matrix of the aluminum alloy Al—10Si—3Cu—1Ni—1Mg—2Fe. The other optical microphotographs showed that in the extruded products, the SiC particles were dispersed very uniformly in the matrices of the aluminum alloys.

Example 8

Into a molten aluminum alloy having the composition Al—10Si—3Cu—1Ni—1Mg, 20% of SiC particles (average particle size=25 μm) were uniformly dispersed. And, into a molten aluminum alloy having the same composition, 20% of SiC particles (average particle size=25 μm) were uniformly dispersed, to which 3% or 6% of Ni was further added. The thus prepared melts were subjected to the atomization using pressurized air, thereby the atomized aluminum matrix composite powders (average particle size=38 μm) were obtained. The optical microphotographs showed that the atomized composite powders comprised the SiC particles dispersed very uniformly in the matrices of the aluminum alloys.

The extruded products were obtained using the above atomized composite powders according to the procedures described in Example 1. The optical microphotographs showed that in the extruded products, the SiC particles were dispersed very uniformly in the matrices of the aluminum alloys.

Test Example 1

The extruded product obtained in Example 1 was worked so as to prepare specimen having parallel part (ϕ6×40 mm) and the total length of 80 mm. As a control, a specimen was prepared similarly from the casted composite obtained in Comparative Example. After subjecting to a T6 treatment, mechanical properties of each specimen were tested. The results are shown in Table 2.

TABLE 2

| | tensile strength (kgf/mm²) | 0.2% proof stress (kgf/mm²) | elongation (%) | Izod impact value (J/cm²) |
|---|---|---|---|---|
| invention | 34.8 | 29.4 | 5.5 | 8.59 |
| control | 33.8 | 29.5 | 0.3 | 1.35 |

tensile properties: JIS Z 2241
Izod impact value JIS Z 2242

As clear from the results in Table 2, the atomized composite powders of the present invention is very superior in ductility and wear impact of the product as compared with the casted composite. Accordingly, the atomized composite powders of the present invention is very useful as industrial materials.

Test Example 2

The extruded products obtained in Example 7 was worked so as to prepare specimens, each having parallel part (ϕ6×40 mm) and the total length of 80 mm. After subjecting to a T6 treatment, each specimen was kept at 200° C. for 100 hours. Then, the mechanical properties of each specimen were tested at 200° C. The results are shown in Table 3.

TABLE 3

| | tensile strength (kgf/mm²) | 0.2% proof stress (kgf/mm²) | elongation (%) |
|---|---|---|---|
| Al—10Si—3Cu—1Ni—1Mg | 23.0 | 20.3 | 4.9 |
| Al—10Si—3Cu—1Ni—1Mg—2Fe | 24.6 | 21.8 | 3.6 |
| Al—10Si—3Cu—1Ni—1Mg—4Fe | 26.1 | 24. | 2.2 |

As clear from the results in Table 3, the tensile strength and 0.2% proof stress were more improved with the increase of the Fe content.

Test Example 3

The extruded products obtained in Example 8 was worked so as to prepare specimens, each having parallel part (ϕ6×40 mm) and the total length of 80 mm. After subjecting to a T6 treatment, each specimen was kept at 200° C. for 100 hours. Then, the mechanical properties of each specimen were tested at 200° C. The results are shown in Table 4.

TABLE 4

| | tensile strength ($kgf/mm^2$) | 0.2% proof stress ($kgf/mm^2$) | elongation (%) |
|---|---|---|---|
| Al—10Si—3Cu—1Ni—1Mg | 23.0 | 70.3 | 4.9 |
| Al—10Si—3Cu—4Ni—1Mg | 27.0 | 16.4 | 2.3 |
| Al—10Si—3Cu—7Ni—1Mg | 32.6 | 31.1 | 1.0 |

As clear from the results in Table 4, the tensile strength and 0.2% proof stress were more improved with the increase of the Ni content.

We claim:

1. An atomized composite powder comprising 1 to 40% by weight of ceramic particles uniformly dispersed in a matrix of aluminum-silicon alloy the powder having a particle size of 350 μm or less, the powder prepared by a rapid solidification at a rate of $10^2$ °K./sec or more.

2. A composite powder according to claim 1, wherein the powder has an average particle size of about 28 to 38 μm.

3. A composite powder according to claim 1, wherein the ceramic particles have an average particle size of about 10 to 40 μm.

4. A composite powder according to claim 1, wherein the ceramic particles comprise a material selected from the group consisting of carbide, oxide, nitride and boride.

5. A composite powder according to claim 4, wherein the ceramic particles comprise a material selected from the group consisting of carbide and oxide.

6. A composite powder according to claim 1, wherein the ceramic particles have an average particle size of 1 to 40 μm.

7. A composite powder according to claim 1, wherein the matrix comprises aluminum silicon and at least one of Cu and Mg.

8. A composite powder according to claim 7, wherein the matrix comprises aluminum, 1 to 50% by weight of Si, and a material selected from 0.5 to 10% by weight of Cu and 0.5 to 10% by weight of Mg.

9. A composite powder according to claim 1, wherein the matrix further comprises at least one of the transition metals.

10. A composite powder according to claim 9, wherein the matrix comprises 0.5 to 15% by weight of at least one of the transition metals.

11. A consolidated product prepared from the aluminum matrix composite powder according to any one of claims 4 to 10 and 1.

* * * * *

UNITED STATES PATENT AND TRADEMARK OFFICE
CERTIFICATE OF CORRECTION

PATENT NO. : 5,435,825

DATED : July 25, 1995

INVENTOR(S) : J. Kusui, et al.

It is certified that error appears in the above-identified patent and that said Letters Patent is hereby corrected as shown below:

On the title page: Item

[73] Please change "Aluminum" to --Aluminium--.

Signed and Sealed this

Fifth Day of March, 1996

*Attest:*

*Attesting Officer*

BRUCE LEHMAN

*Commissioner of Patents and Trademarks*